US011598113B2

(12) United States Patent
Sidhu

(10) Patent No.: US 11,598,113 B2
(45) Date of Patent: Mar. 7, 2023

(54) MEMORIAL DISPLAY SYSTEM

(71) Applicant: Baljit Sidhu, Mississauga (CA)

(72) Inventor: Baljit Sidhu, Mississauga (CA)

( * ) Notice: Subject to any disclaimer, the term of this patent is extended or adjusted under 35 U.S.C. 154(b) by 0 days.

(21) Appl. No.: 17/218,109

(22) Filed: Mar. 30, 2021

(65) Prior Publication Data

US 2021/0222453 A1 Jul. 22, 2021

Related U.S. Application Data

(63) Continuation-in-part of application No. 16/710,604, filed on Dec. 11, 2019, now abandoned, which is a continuation-in-part of application No. 16/046,570, filed on Jul. 26, 2018, now abandoned.

(51) Int. Cl.
*E04H 13/00* (2006.01)

(52) U.S. Cl.
CPC ..... *E04H 13/003* (2013.01)

(58) Field of Classification Search
CPC ..... E04H 13/00; E04H 13/003; E04H 13/006; E04H 13/008
See application file for complete search history.

(56) References Cited

U.S. PATENT DOCUMENTS

| | | | | | |
|---|---|---|---|---|---|
| 955,720 | A * | 4/1910 | Thomas | E04H 13/003 | 40/124.5 |
| 1,274,809 | A * | 8/1918 | Storm, Jr. | E04H 13/003 | D99/24 |
| 2,124,143 | A * | 7/1938 | Long | E04H 13/00 | D99/24 |
| 5,546,710 | A * | 8/1996 | Barry | E04H 13/003 | 52/157 |
| 5,732,515 | A * | 3/1998 | Rodrigues | E04H 13/003 | 52/103 |
| 6,006,458 | A * | 12/1999 | Weiss | A61G 17/08 | 52/103 |
| 10,233,663 | B1 * | 3/2019 | Grupp | E04H 13/003 | |
| 2005/0257444 | A1 * | 11/2005 | Timms | E04H 13/003 | 52/103 |
| 2015/0252583 | A1 * | 9/2015 | Dvorak | E04H 13/006 | 52/133 |
| 2020/0115918 | A1 * | 4/2020 | Sidhu | E04H 13/003 | |
| 2021/0222453 | A1 * | 7/2021 | Sidhu | E04H 13/003 | |

* cited by examiner

*Primary Examiner* — Andrew J Triggs
(74) *Attorney, Agent, or Firm* — Runyan Law; Charles Runyan; Michael Balaguy

(57) ABSTRACT

A memorial display system including a memorial assembly having a grave marker, a storage compartment, and indicia. The grave marker includes an integral storage compartment and the indicia. The storage compartment is a transparent display case. The indicia is displayed on the front surface of the grave marker. The memorial assembly is modular and configured to secure and seal pre-selected memorial items as contents for viewing.

9 Claims, 7 Drawing Sheets

MEMORIAL DISPLAY SYSTEM

CROSS-REFERENCE TO RELATED APPLICATIONS

The present application is a continuation-in-part of U.S. Utility patent application Ser. No. 16/710,604, filed on Dec. 11, 2019, pending, which is a continuation-in-part of U.S. Utility patent application Ser. No. 16/046,570, filed on Jul. 26, 2018, abandoned—the application incorporates both applications by this reference.

BACKGROUND OF THE INVENTION

The following includes information that may be useful in understanding the present disclosure. It is not an admission that the provided information is prior art or material to the described or claimed inventions or any publication or document expressly or implicitly referenced is prior art.

FIELD OF THE INVENTION

The present device generally relates to memorial devices and relates to a memorial grave marker accessory.

DESCRIPTION OF RELATED ART

Since the earliest days, commemorative information about a deceased individual has been sought to be placed near the deceased individual's resting place. Etching has been placed on a grave marker or a plaque added to the grave marker or an urn to commemorate a deceased's life. Generally, the information available in this manner has been basic information such as the date of birth of the individual and their date of death. For persons seeking to give more information about the deceased individual, options have been limited. A suitable solution is desired.

U.S. Pub. No. 2008/0244994 to Allan Burman relates to a monument assembly and method of installation. The described monument assembly and method of installation include a monument assembly formed from (i) a headstone component; (ii) a rail assembly attached to the headstone component; and (iii) an inlay panel supported by and surrounded by the rail assembly surrounds and open space.

BRIEF SUMMARY OF THE INVENTION

Because of the preceding disadvantages inherent in the known memorial devices art, the present disclosure provides a novel memorial display system. This disclosure provides a memorial grave marker accessory with a vault security display case to place important memorabilia of someone within it.

A memorial display system is disclosed.

In some versions, the memorial display system has a memorial assembly that includes a storage compartment that fits into the memorial assembly and has an installed configuration and an uninstalled configuration. The storage compartment has An access wall, an access portal disposed in the access wall, a window wall, a secure window disposed in the window wall, and a bottom with an inside surface that can be seen through the secure window. The access portal cannot be opened unless the storage compartment has been removed from the memorial assembly. It has an installed configuration in which the access portal cannot be opened and an uninstalled configuration in which the access portal can be opened. In some versions, the storage compartment is removed from the memorial assembly to allow the access portal to be opened.

In some versions, the storage compartment has a portal lock on the portal door. In these or other versions, the portal lock can only be accessed when the storage compartment is in the uninstalled configuration.

The memorial assembly may include a locking member. This locking member can lock the storage compartment into the memorial assembly.

In some versions, the memorial display system is configured to mount to a wall or in a wall. In some versions, the memorial display systems are configured to mount in a grave marker.

The grave marker may have an opening to receive the storage compartment when the storage compartment is in the installed configuration. In some grave-marker versions with a locking member, the locking member locks the storage compartment into the grave marker. The grave marker may be or may comprise a metal such as stainless steel, aluminum, brass, and steel.

In some versions, the memorial display system may have one or more shelves to support a three-dimensional display object, such as memorabilia related to the deceased. The shelves may be adjustable and may use magnetic mounts to facilitate their adjustability.

The grave marker may have a base cover plate, a base, fasteners, a flange, and a side panel. These components mount the grave marker to the ground and cover or disguise the fasteners, such as security fasteners, that may be used to connect the base to the flange. The base may be attached to the ground through the bracket. The bracket can extend into a concrete mount, and in some versions, resist vertical loads or vertical pulling forces of 200-1000 pounds In some versions, markings about the deceased, such as bibliographic data or other information related to the individual's life and death, are displayed on the memorial display system. Some versions use a removable front plate mounted to the assembly's surface or the grave marker for containing that information. The front plate may be spaced, for example, using spacers from the assembly's surface and an amount sufficient to prevent moisture from lodging between the plate and the surface to protect the gravestone or memorial assembly from the elements.

BRIEF DESCRIPTION OF THE DRAWINGS

These figures illustrate various exemplars of the disclosed device or method, a memorial display system.

DETAILED DESCRIPTION

Embodiments of the present disclosure relate to memorial devices and, more particularly, to a memorial display system to improve a deceased individual's personalization and memorial.

Generally, the memorial display system includes a marker with a vault security display case to place important memories of someone within it. The marker and display case comprises stainless steel (or other suitable material or metal material). Hinges, security screws, and a safety glass may create a locking system to secure and protect personnel property. The marker may include indicia such as a name, date, or other etched, engraved, etc. markings. In some exemplars, the marker may include a removable front plate. Placing the indicia on a removable front plate allows a seller to maintain an inventory of markers and conveniently place customized indicia on the front plate. This removability also allows removal after initial placement to change the indicia, such as adding a spouse's name to the marker when the time comes. The device may further include a light on top of the unit to light the security display case and display its items. The light may be solar-powered or include other suitable powering means. In certain embodiments, adjustable selves may be included within the display case to support items thereon. Magnetic fasteners may secure items on the shelves. In other exemplars, the memorial assembly may be configured for wall mounting (to a wall or in a wall), for instance, to provide an in-home memorial site. The storage compartment may be modular in other exemplars—provided separately to be integrated into a memorial assembly later. The memorial display system provides means for displaying personal memorabilia items in a transparent display. In various embodiments, the accessory mounts in, on, or beside the grave marker. In some versions, the accessory replaces or serves as the grave marker.

Figure 1:
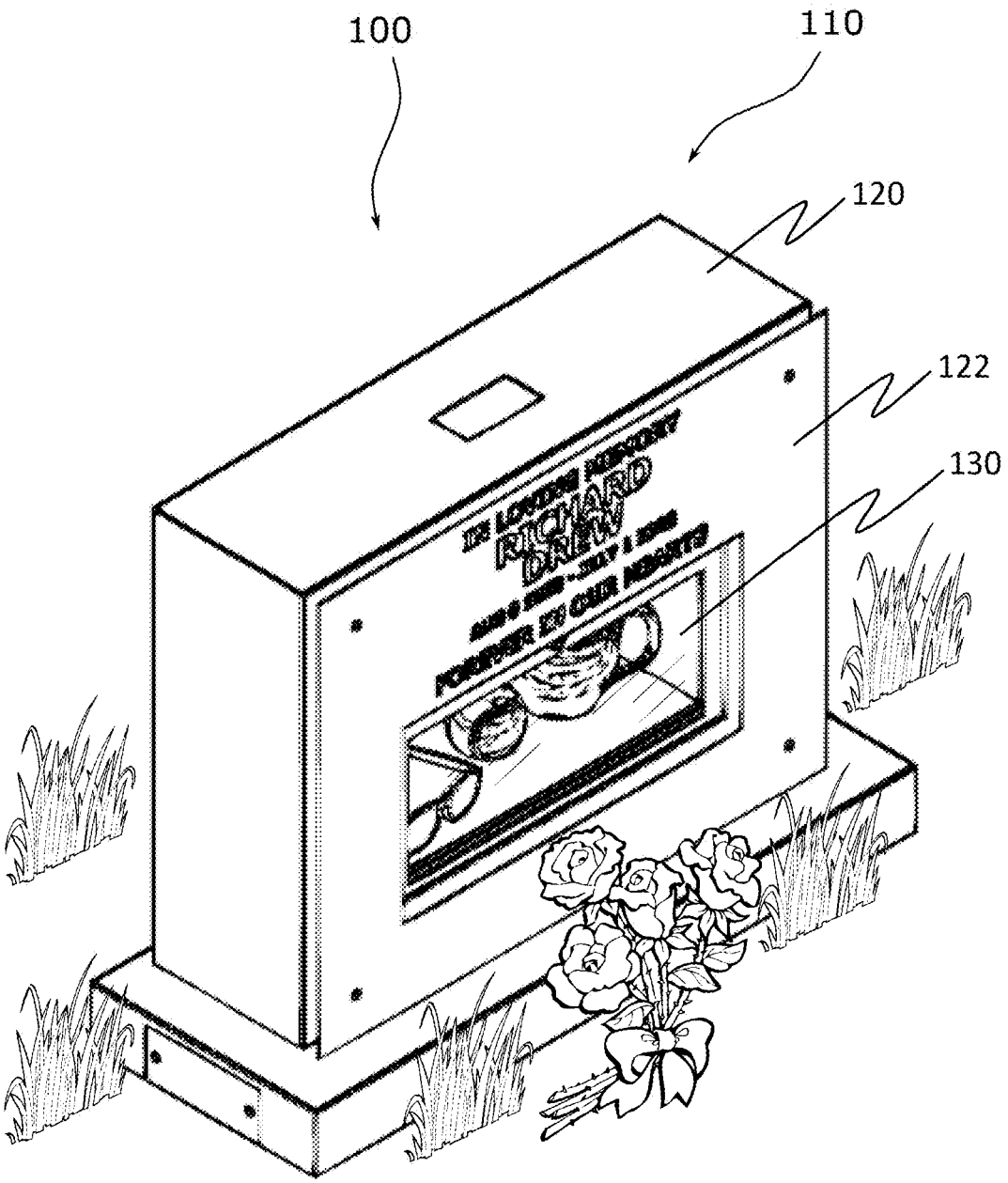
FIG. 1 is a perspective view of the memorial display system during an in-use condition.

FIGS. 1-5 show various views of a memorial display system. FIG. 1 shows a memorial display system 100 during an in-use condition. As illustrated, the memorial display system may include a memorial assembly 110, a grave marker 120, a storage compartment 130, and indicia 140. The memorial assembly 110 or grave marker 120 may include an internal storage compartment 130, a window wall 732 with a secure window 733 or front panel 132, a bottom 734, and indicia 140. In some exemplars, front panel 132 is a door. In these or other exemplars, the door is not openable from the outside of grave marker 120. For example, in some versions, the door is hidden inside of grave marker 120, and access into storage compartment 130 is achieved by first removing storage compartment 130 from grave marker 120 followed by opening the door into the storage compartment 130. The storage compartment 130 can be a transparent display case. The indicia 140 is displayed on a front surface 122 of the grave marker 120. The indicia 140 may be etched or engraved on a separate panel that can be secured to the grave marker 120 or the memorial assembly 110. In some exemplars, the removable front plate mounts to the grave marker 120 through stand-offs 121 or is mounted with spacing between the plate and the surface of grave marker 120 or memorial assembly 110. This mounting facilitates removal and prevents moisture from lodging in the space 200 behind the panel, accelerating grave marker 120 degradation. Thus, the spacing is large enough or sufficient to prevent moisture from lodging in the space 200. The memorial assembly 110 is modular and configured to secure and seal pre-selected memorial items within for viewing.

Figure 2:
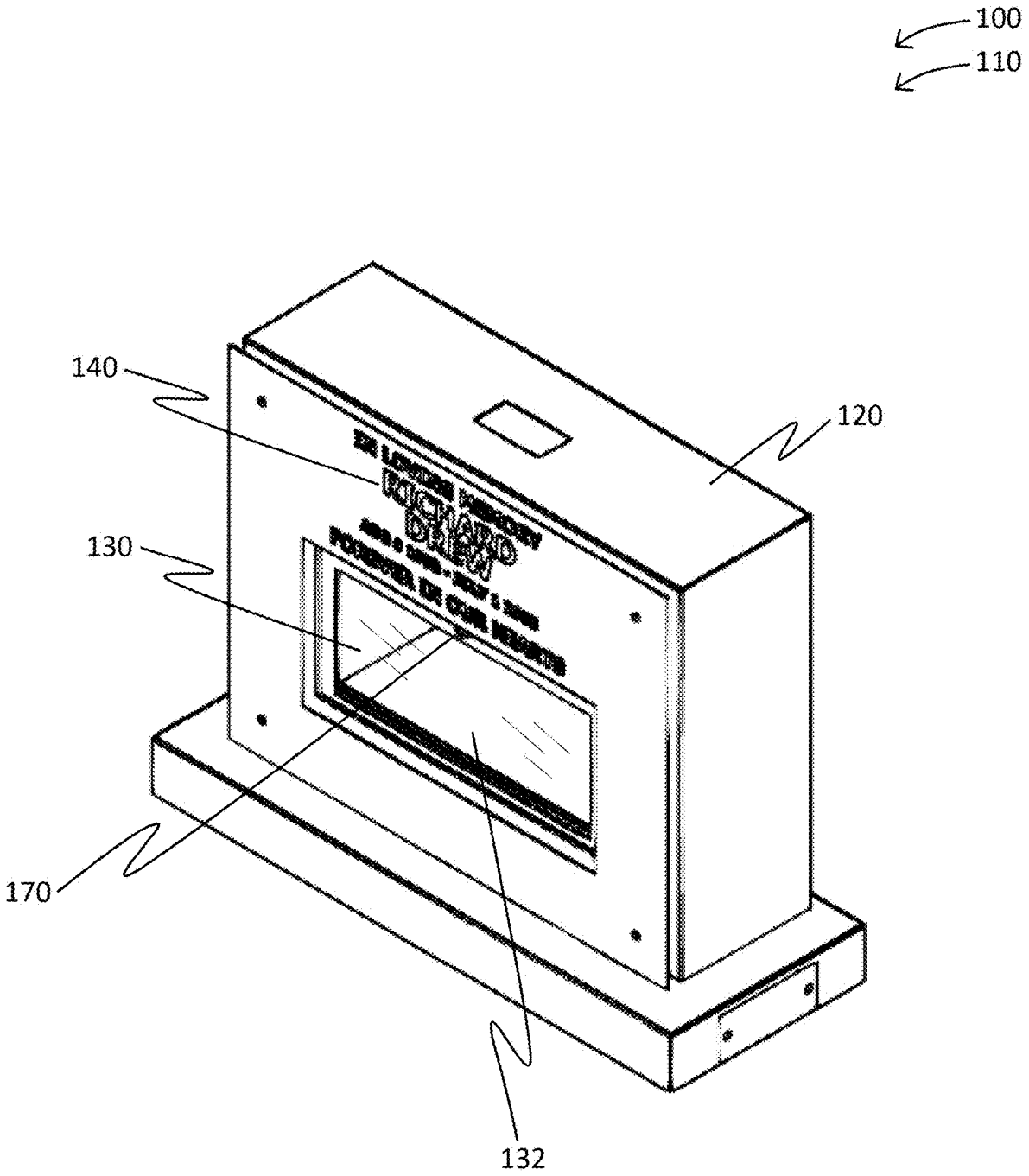
FIG. 2 is a perspective view of the memorial display system of FIG. 1.

FIG. 2 shows a perspective view of the memorial display system of FIG. 1. As above, the memorial display system may include the memorial assembly 110 having the grave marker 120, the storage compartment 130, and the indicia 140, such as identifying information about the deceased. The storage compartment 130 includes a transparent panel 132 configured to secure the contents within the storage compartment 130. The transparent panel 132 may be removable or configured to open and close, allowing for insertion of pre-selected memorial items within the storage compartment 130. The transparent panel 132 sometimes comprises security film. In certain embodiments, the transparent panel 132 is hinged to the grave marker 120 and configured to open and close. In some of these exemplars, the opening between transparent panel 132 and storage compartment 130 contains a gasket or other device to improve the opening's water-resistance. Sometimes, transparent panel 132 is mounted in a door frame 133 in a waterproof way. Mounting in a frame 133 allows for easier replacement if the transparent panel 132 becomes broken. The transparent panel 132 is shatter-proof and may comprise a plastic or glass material. In some exemplars, shatterproof is defined as accepting a collision with an object moving at 50 mph.

Figure 3:
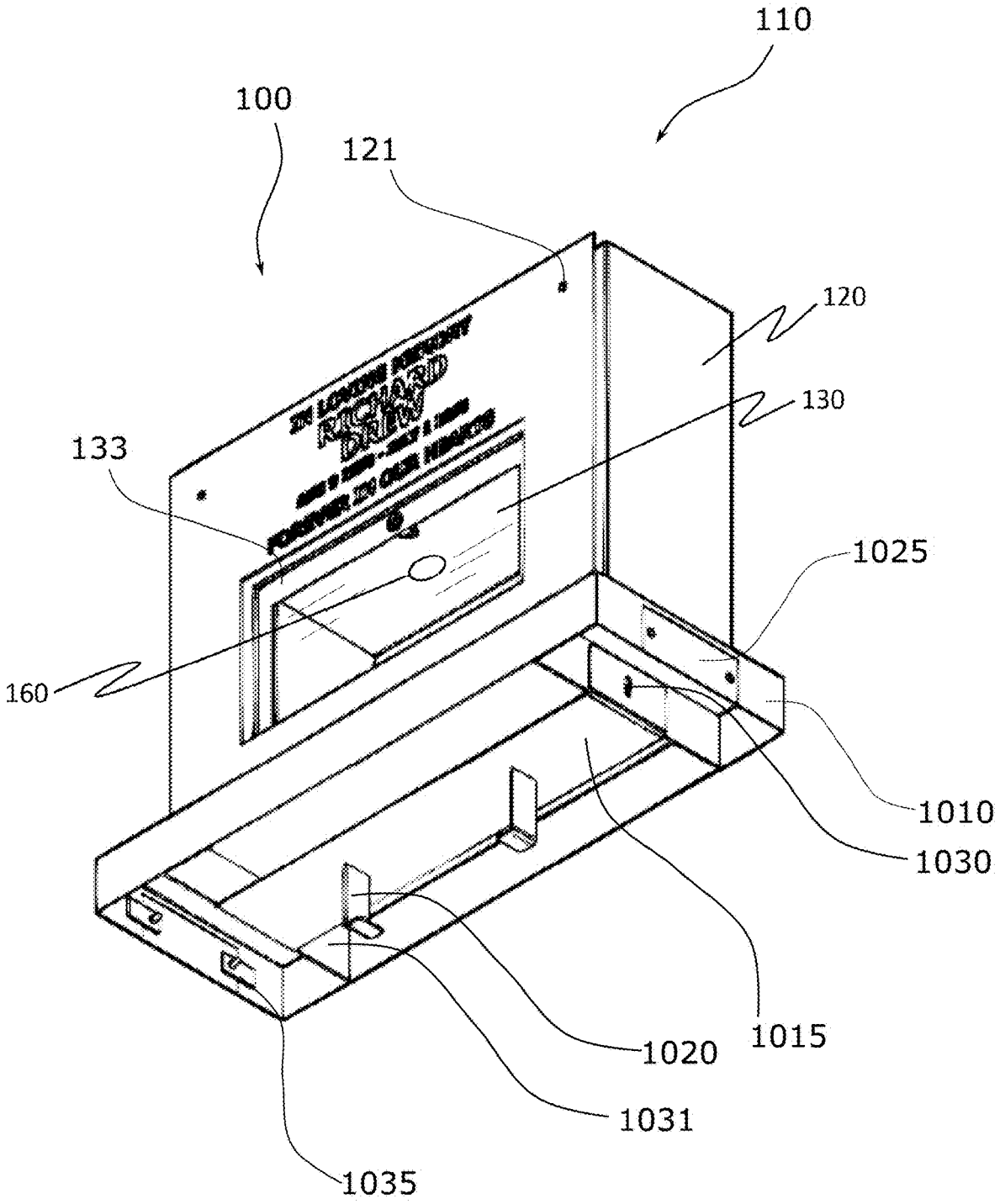
FIG. 3 is a perspective view of the memorial display system of FIG. 1.

FIG. 3 shows a perspective view of the memorial display system of FIG. 1. As above, the memorial display system may include the grave marker 120, the storage compartment 130, and the indicia of 140. The transparent panel 132 of the storage compartment 130 allows visitors to a gravesite to view memorabilia and other contents within. The memorial assembly 110 may further comprise a light member 160. The light member 160 is configured within the storage compartment 130 to illuminate an inner cavity. In some exemplars, the light member 160 is solar-powered. Other suitable powering means may be used.

FIG. 3 also shows base 1015, base cover 1010, and side-panel (left & right) covers 1025 that cover the access to base 1015 and the fasteners 1030 (sometimes security fasteners) that connect base 1015 to flange 1031. Base 1015 mounts to the ground through base bracket 1020. In some exemplars, base bracket 1030 connects base 1015 to a concrete base, slab, or mount. In these or other exemplars, the attachment or connection to the ground is capable of withstanding greater than 200 lbs of upward force. Threaded back plates 1035 attach covers 1025 to base cover 1010.

Figure 4:
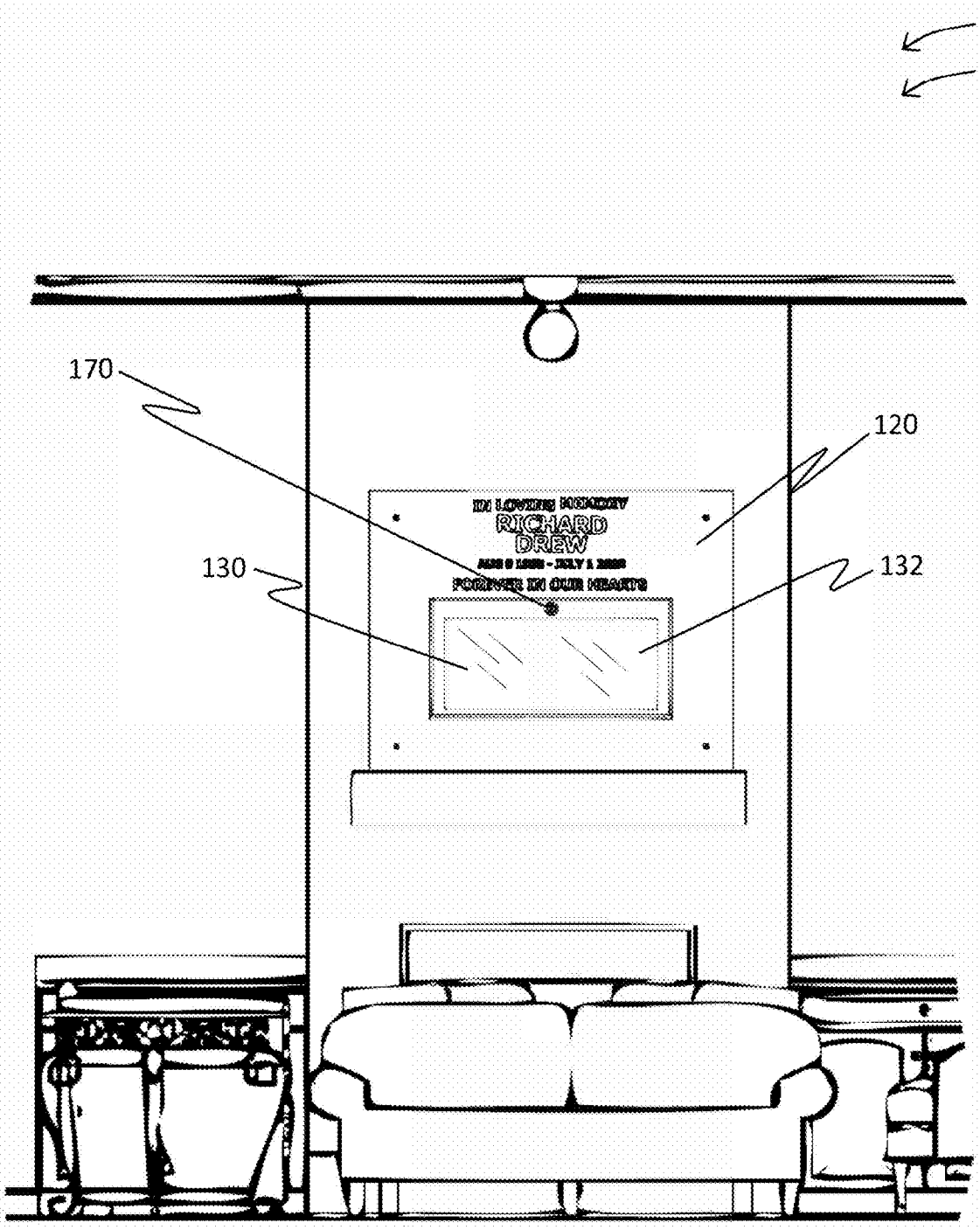
FIG. 4 is a perspective view of the memorial display system of FIG. 1.

FIG. 4 shows a perspective view of the memorial display system of FIG. 1. As above, the memorial display system may include the grave marker 120 and the storage compartment 130. The transparent panel 132 provides a viewing window for visitors to view contents stored within storage compartment 130. The grave marker 120 may be constructed using a metal material such as stainless steel, aluminum, brass, and steel. The grave marker 120 is customizable and may include receptacles used for holding flowers.

Figure 5:
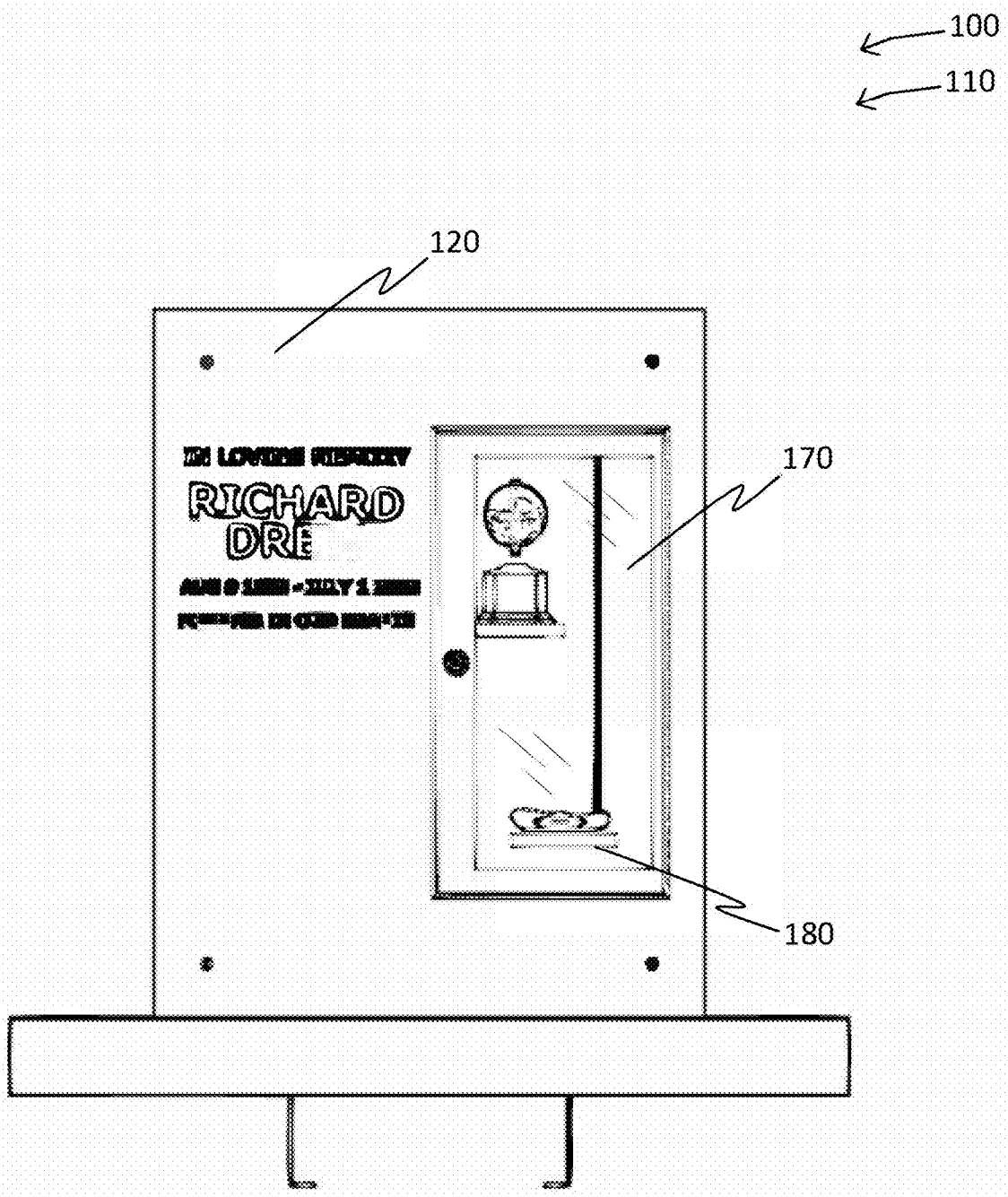
FIG. 5 is a perspective view of the memorial display system of FIG. 1.

FIG. 5 shows a perspective view of the memorial display system of FIG. 1. As above, the memorial display system may include the memorial assembly 110 having the grave marker 120, the storage compartment 130, and indicia 140 (to locate the individual in the graveyard, etc.). The memorial assembly 110 further includes a locking member 170 configured to eliminate unwanted access or theft of items stored within the storage compartment 130. The locking member 170 may include a cam lock, a push lock, or other suitable locking means. In some exemplars, the locking member 170 is waterproof and accessible for a key holder. In some exemplars, shelves 180 may be included in the storage compartment 130 for holding items in position. The shelves 180 may be adjustable or reconfigurable, and magnetic fasteners may secure the shelves 180 and items, such as three-dimensional items, placed on the shelves in position. In such cases, shelves 180 or configured to support the three-dimensional object. These fasteners attach the shelves 180 to the inside wall of the storage compartment with enough strength to secure the shelves 180 and their content. Likewise, in some exemplars, the magnetic fasteners attach the shelves adequately, where "adequately" is defined as enough strength to retain the shelf against external impacts, such as attempted vandalism.

Figure 6:
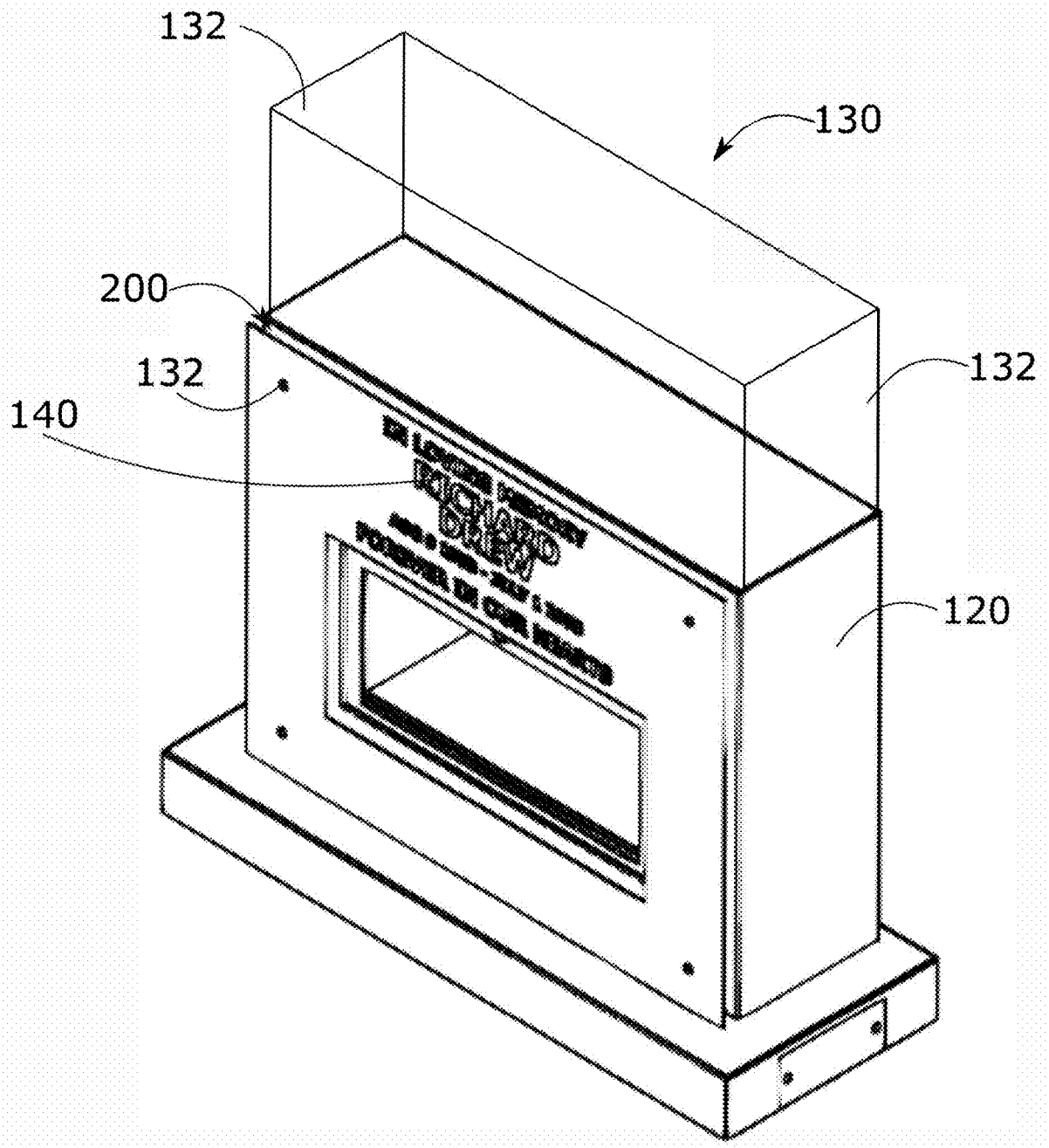
FIG. 6 is a perspective view of another exemplar of the display system.

FIG. 6 shows storage compartment 130 transparent.

Figure 7:
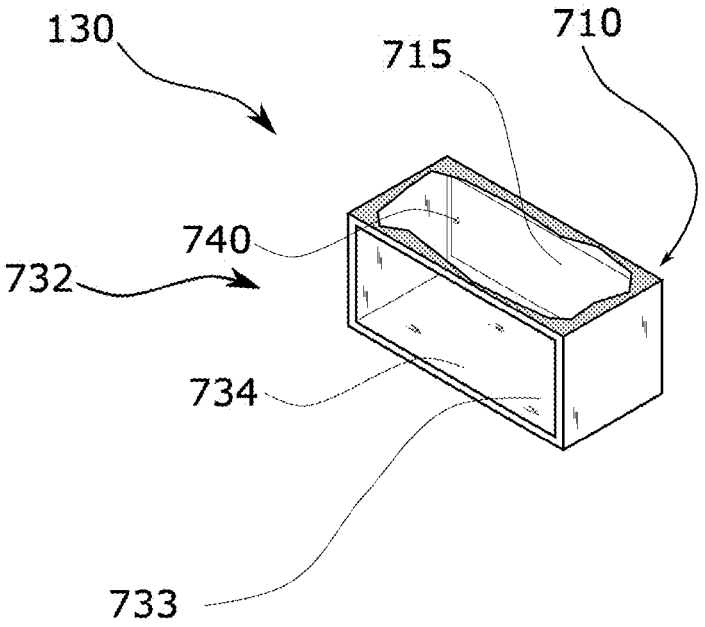
FIG. 7 is a perspective view of an exemplar of a storage compartment of the memorial display system

FIG. 7 shows storage compartment 130 with an access wall 710, an access portal 715 disposed in the access wall 710, a window wall 732 with a secure window 733, a bottom 734, and a portal lock 740.

What is claimed is:

1. A memorial display system comprising a memorial assembly including:

a storage compartment having an installed configuration and an uninstalled configuration and comprising an access wall, an access portal disposed in the access wall, a window wall, a secure window disposed in the window wall, at least one shelf configured to support a three-dimensional display object a bottom with a surface that can be seen through the secure window, and a grave marker comprising a metal selected from stainless steel, aluminum, brass, and steel, with a base cover plate, a base, fasteners, a flange, and a side-panel cover and having an opening to receive the storage compartment when the storage compartment is in the installed configuration, a locking member that locks the storage compartment into the grave marker in the memorial assembly wherein in the uninstalled configuration, outside of the assembly, the access portal is openable, in the installed configuration, inside of the assembly, the access portal is not openable, wherein the storage compartment further comprises a portal lock that is only accessible when the storage compartment is in the uninstalled configuration.

2. The memorial display system of claim 1 configured to mount to a wall.

3. The memorial display system of claim 1 configured to mount in a wall.

4. The memorial display system of claim 1, wherein the base attaches to the ground through a base bracket and the fasteners connect the base to the flange.

5. The memorial display system of claim 4, wherein the base attaches to the ground through an attachment that resists an upward force of 200 pounds.

6. The memorial display system of claim 5, wherein the fasteners are security fasteners.

7. The memorial display system of claim 6, wherein the shelf is adjustable and comprises magnetic fasteners for adjustable mounting.

8. The memorial display system of claim 7 further comprising a removable front plate mounted to a surface of the assembly spaced from the surface an amount sufficient to prevent moisture from lodging in the space between the plate and the surface.

9. The memorial display system of claim 7 further comprising a removable front plate mounted to a surface of the grave marker spaced from the surface an amount sufficient to prevent moisture from lodging in the space between the plate and the surface.

* * * * *